US007535314B2

(12) United States Patent
Saitoh

(10) Patent No.: US 7,535,314 B2
(45) Date of Patent: May 19, 2009

(54) LINE TRANSITION DEVICE, HIGH-FREQUENCY MODULE, AND COMMUNICATION APPARATUS

(75) Inventor: Atsushi Saitoh, Komatsu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 12/032,175

(22) Filed: Feb. 15, 2008

(65) Prior Publication Data

US 2008/0136550 A1 Jun. 12, 2008

Related U.S. Application Data

(63) Continuation of application No. PCT/JP2006/316356, filed on Aug. 22, 2006.

(30) Foreign Application Priority Data

Aug. 25, 2005 (JP) ..... 2005-243589

(51) Int. Cl.
*H01P 5/107* (2006.01)

(52) U.S. Cl. ..... 333/26; 333/248

(58) Field of Classification Search ..... 333/26, 333/248

See application file for complete search history.

(56) References Cited

U.S. PATENT DOCUMENTS

| | | | | |
|---|---|---|---|---|
| 5,808,519 | A * | 9/1998 | Gotoh et al. | 333/26 |
| 2003/0042993 | A1 * | 3/2003 | Sayanagi et al. | 333/26 |
| 2005/0285694 | A1 * | 12/2005 | Saitoh | 333/26 |

FOREIGN PATENT DOCUMENTS

| | | |
|---|---|---|
| JP | 52010656 | 1/1977 |
| JP | 64-17502 | 1/1989 |
| JP | 05-335815 | 12/1993 |
| JP | 10-261914 | 9/1998 |
| JP | 2003-078310 | 3/2003 |
| JP | 2003-133815 | 5/2003 |
| JP | 2004-147291 | 5/2004 |
| JP | 2004-187281 | 7/2004 |
| JP | 2004-320460 | 11/2004 |
| WO | WO 2005/018039 | 2/2005 |
| WO | WO 2007/023779 | 3/2007 |

OTHER PUBLICATIONS

PCT/JP2006/316356 International Search Report dated Nov. 21, 2006.
PCT/JP2006/316356 Written Opinion dated Nov. 21, 2006.

* cited by examiner

*Primary Examiner*—Benny T. Lee
(74) *Attorney, Agent, or Firm*—Dickstein Shapiro LLP

(57) ABSTRACT

A line transition device that includes a waveguide and a microstrip line. The microstrip line is substantially orthogonal to an electromagnetic wave propagation direction in the waveguide. A choke groove crosses the microstrip line. A coupling conductor provided at a tip of the microstrip line is positioned at a terminal end of and inside the waveguide. A slit-like region where a ground conductor is not formed is substantially orthogonal to the electromagnetic wave propagation direction in the waveguide. A longitudinal length of the slit-like region is substantially equal to a quarter of the wavelength of electromagnetic waves. The slit-like region is provided such that it extends from an end of a ground conductor near a boundary between the coupling conductor and the microstrip line to reach the choke groove.

9 Claims, 9 Drawing Sheets

(A)

(B)

(A)

(B)

LINE TRANSITION DEVICE, HIGH-FREQUENCY MODULE, AND COMMUNICATION APPARATUS

CROSS REFERENCE TO RELATED APPLICATIONS

The present application is a continuation of International Application No. PCT/JP2006/316356, filed Aug. 22, 2006, which claims priority to Japanese Patent Application No. JP2005-243589, filed Aug. 25, 2005, the entire contents of each of these applications being incorporated herein by reference in their entirety.

FIELD OF THE INVENTION

The present invention relates to a line transition device for transmission lines used in microwave bands and millimeter wave bands, and to a high-frequency module and a communication apparatus including the line transition device.

BACKGROUND OF THE INVENTION

Conventionally, as a line transition device for coupling different types of transmission lines, there is known a line transition device formed by inserting part of a planar circuit (microstrip line) provided on a dielectric substrate into a waveguide in a conductor block. Examples of such a line transition device are disclosed in Patent Document 1 and Patent Document 2.

FIG. 1(A) illustrates an exemplary configuration of a line transition device described in Patent Document 1. A line transition device 1 is formed by providing grooves 4A and 4B constituting a waveguide 4 in respective conductor blocks 2 and 3, which are separated by a plane parallel to the E-plane of the waveguide, and inserting part of a dielectric substrate 5 into the waveguide 4 in a direction parallel to the E-plane. The dielectric substrate 5 is provided with a line conductor 6 and a ground conductor 7 of a microstrip line. Ends of the line conductor 6 and the ground conductor 7 are positioned at the terminal end of the waveguide 4. In the waveguide 4, the line conductor 6 and the ground conductor 7 are close to the H-plane of the waveguide 4 and each have a plurality of open stubs (not shown) having a stub length equal to a quarter of the wavelength of electromagnetic waves. Through the open stubs, conductors of the waveguide 4 are coupled to the line conductor 6 and the ground conductor 7 at high frequencies.

In such a line transition device, if a gap is created at the interface between a conductor block having a waveguide and a dielectric substrate having transmission lines, spurious electromagnetic waves may be generated in the gap and cause an increase in radiation loss.

Patent Document 2 proposes a configuration illustrated in FIG. 1(B) as a solution to this problem. As in the case of the configuration described above, a line transition device 1 of FIG. 1(B) has a waveguide 4 in a conductor block 2. To solve the problem described above, the line transition device 1 of FIG. 1(B) is provided with a choke groove G22 surrounding the terminal end of the waveguide 4. Since this suppresses generation of spurious electromagnetic waves in a gap at the interface between the conductor block 2 and a dielectric substrate (not shown), a line transition device with less radiation loss can be provided.

Patent Document 1: Japanese Unexamined Patent Application Publication No. 5-335815

Patent Document 2: Japanese Unexamined Patent Application Publication No. 2004-147291

Although the line transition device disclosed in Patent Document 1 allows good coupling of the ground and line conductors to conductors of the waveguide, it is not directed to the suppression of spurious electromagnetic waves in a gap between the dielectric substrate and the conductor block. Moreover, the line transition device disclosed in Patent Document 1, where coupling to the waveguide is made through a plurality of open stubs, requires extremely fine electrodes to deal with high frequency waves (millimeter waves and microwaves) in the microstrip line. This not only makes microfabrication difficult, but may cause interdigital electrodes to break or float and degrade the reliability of the stubs.

On the other hand, to effectively block spurious electromagnetic waves, the line transition device disclosed in Patent Document 2 requires, for example, a square U-shaped choke groove substantially entirely surrounding the terminal end of the waveguide and thus requires a conductor block of large size.

For compactness, a choke groove that only partially surrounds the terminal end of the waveguide may be provided. However, this causes a problem in that spurious electromagnetic waves cannot be sufficiently suppressed. Moreover, since spurious electromagnetic waves cause equivalent short-circuit points of the waveguide to be displaced from each other, the coupling between the waveguide and a planar circuit is weakened.

SUMMARY OF THE INVENTION

Accordingly, an object of the present invention is to provide a line transition device which can be made in a small size, suppresses spurious electromagnetic waves in a gap between a dielectric substrate and a conductor block, and allows better coupling between a waveguide and a planar circuit; and also to provide a high-frequency module and a communication apparatus including the line transition device.

A line transition device according to the present invention includes a waveguide provided in a conductor block, a microstrip line including a line conductor and a ground conductor disposed on a dielectric substrate, and a coupling conductor formed by extending an end of the line conductor beyond an end of the ground conductor and positioned at a terminal end of and inside the waveguide. The conductor block has a choke groove located at a position facing the ground conductor and surrounding the terminal end of the waveguide at a distance therefrom. A slit-like no-ground-conductor-formed part is provided near a boundary between the coupling conductor and the microstrip line and at the end of the ground conductor.

As described above, the conductor block is provided with the choke groove, and the dielectric substrate is provided with the no-ground-conductor-formed part. Therefore, even if there is a gap between the conductor block and the ground conductor on the dielectric substrate, a radiation loss caused by spurious electromagnetic waves can be suppressed by the no-ground-conductor-formed part and the choke groove. By providing the no-ground-conductor-formed part at a position where spurious electromagnetic waves cannot be sufficiently suppressed only by the choke groove or at a position where the choke groove cannot be provided and electromagnetic waves leak, it is possible to effectively suppress spurious electromagnetic waves.

Additionally, since spurious electromagnetic waves can thus be suppressed, it is possible to reduce displacement between equivalent short-circuit points of the waveguide and improve coupling between the waveguide and the planar circuit. Moreover, since the degree of freedom in designing the shape of a choke groove is improved, it is possible to realize a compact conductor block and a compact line transition device. Also, as compared to formation of interdigital electrodes, formation of the no-ground-conductor-formed part seldom causes electrodes to float or break and thus, the reliability of electrode formation can be improved.

In the line transition device according to the present invention, the choke groove at least crosses the microstrip line, and the no-ground-conductor-formed part extends from the end of the ground conductor to the choke groove so as to be substantially parallel to the microstrip line.

Thus, by providing the choke groove such that it at least crosses the microstrip line, spurious electromagnetic waves which tend to leak in the direction of the microstrip line can be suppressed by the choke groove. Additionally, since the no-ground-conductor-formed part extends from the end of the ground conductor adjacent to the waveguide to the choke groove so as to be substantially parallel to the microstrip line, spurious electromagnetic waves which tend to leak in the direction between the choke groove and the waveguide can be suppressed. With the configurations described above, it is possible to very effectively block spurious electromagnetic waves and suppress a radiation loss caused by spurious electromagnetic waves.

Additionally, in the line transition device according to the present invention, a longitudinal length of the no-ground-conductor-formed part is substantially equal to a quarter of the wavelength of electromagnetic waves used.

With this configuration, a portion near an end of the no-ground-conductor-formed part adjacent to the choke groove can be reliably short-circuited, while a portion near an end of the no-ground-conductor-formed part adjacent to the waveguide can be reliably open-circuited. Thus, without causing the positions of equivalent short-circuit points of the waveguide to be displaced, the coupling between the waveguide and the planar circuit can be further improved.

A high-frequency module according to the present invention includes the line transition device described above and a high-frequency circuit connected to both the waveguide and the microstrip line of the line transition device.

Thus, a high-frequency module with a reduced transmission loss and improved coupling between high-frequency circuits can be provided.

A communication apparatus according to the present invention includes the above-described high-frequency module in a transmitting/receiving unit for transmitting and receiving electromagnetic waves.

Thus, a communication apparatus with a reduced loss in the transmitting/receiving unit can be provided.

The present invention makes it possible to provide a line transition device which can be made in a small size, suppresses spurious electromagnetic waves in a gap between a dielectric substrate and a conductor block, and allows better coupling between a waveguide and a planar circuit; and also to provide a high-frequency module and a communication apparatus including the line transition device.

REFERENCE NUMERALS

Figure 1:
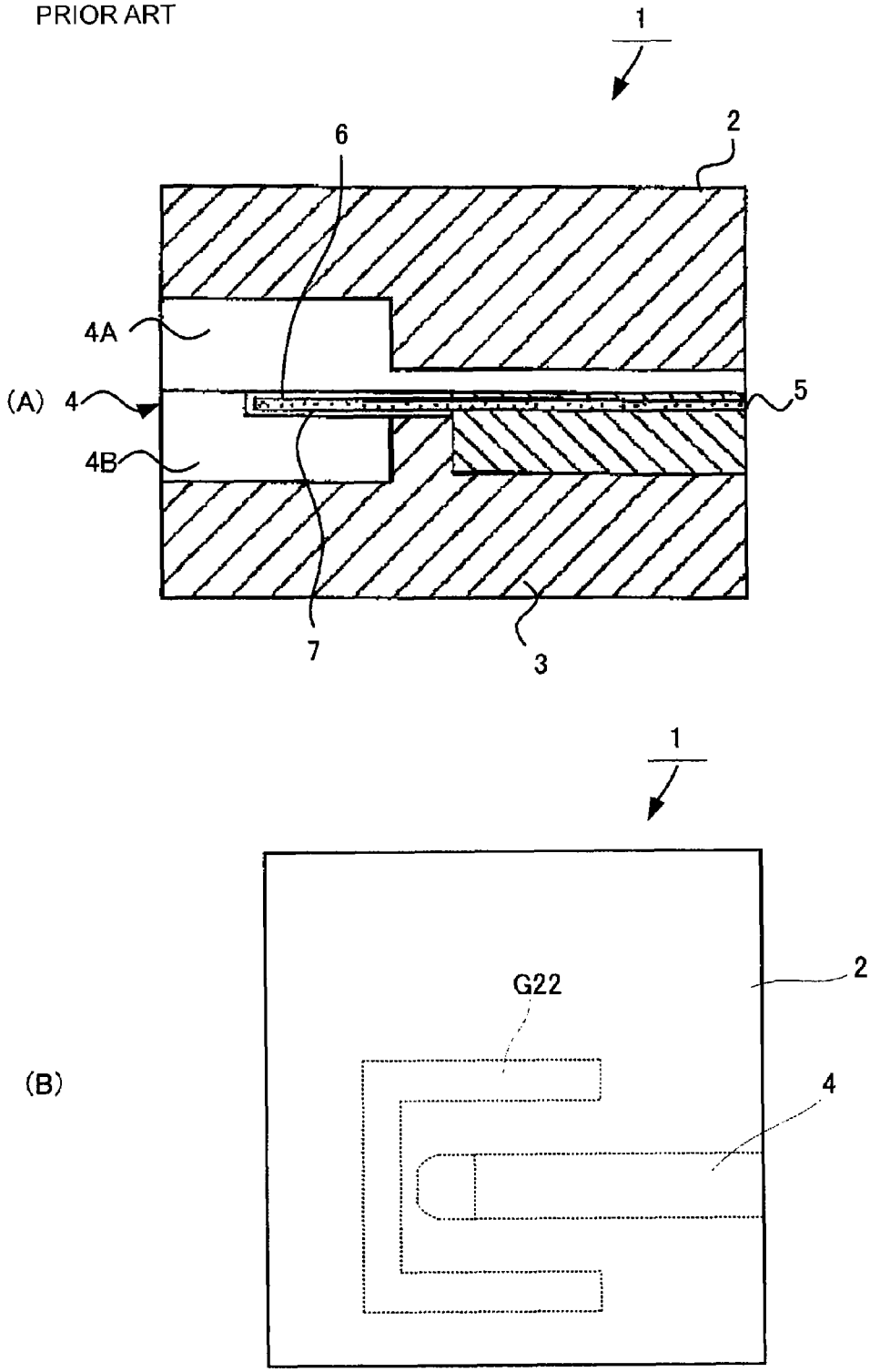
FIG. 1 PRIOR ART
FIG. 1(A) and FIG. 1(B) each illustrate a configuration of a conventional line transition device.

11: line transition device
12, 42: upper conductor block
13: lower conductor block
14, 44: waveguide
14A, 44A: upper waveguide groove
14B: lower waveguide groove
15, 25, 35, 45: dielectric substrate
16, 26, 36: line conductor
17, 27A, 37A, 47A: ground conductor
18: microstrip line
19: choke groove
20: line groove
21, 31, 41: coupling conductor
22: cap clearance

DETAILED DESCRIPTION OF THE INVENTION

A configuration of a line transition device according to a first embodiment of the present invention will now be described with reference to FIGS. 2(A)-2(D), 3(A)-3(D), 4(A), 4(B), 5(A), 5(B), 6(A) and 6(B).

In the present embodiment, a planar circuit including electronic components and wiring elements mounted on a substrate is connected to a microstrip line 18. A tip of a line conductor 16 in the microstrip line 18 is pulled out to an edge of the substrate. Then, a coupling conductor 21 is attached to the tip of the line conductor 16 and positioned inside a waveguide 14 in a conductor block. See FIGS. 3(A)-3(D). Thus, a suspended line antenna is formed, which allows line transition to be performed. The planar circuit may be covered with a protective cap.

Figure 2:
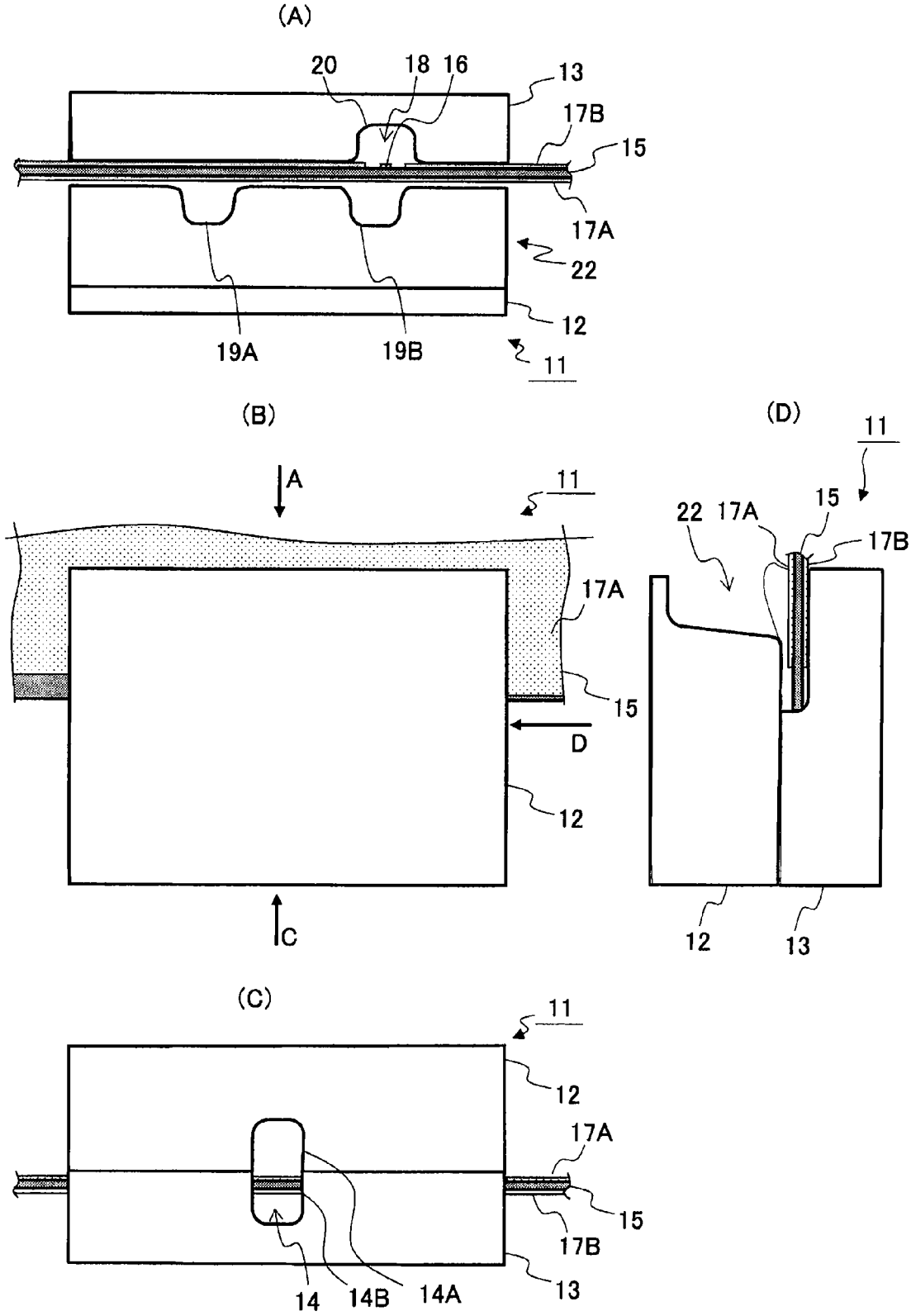
FIG. 2(A) to FIG. 2(D) are plan views illustrating a configuration of a line transition device according to a first embodiment of the present invention.

FIGS. 2(A)-2(D) illustrate a configuration of a line transition device 11. FIG. 2(B) is a plan view of an upper conductor block 12. FIG. 2(A) is a rear view of the conductor blocks 12 and 13 viewed from the side of the microstrip line 18 (i.e., viewed from direction A indicated in FIG. 2(B)). FIG. 2(C) is a front view of the conductor blocks 12 and 13 viewed from the side of the waveguide 14 (i.e., viewed from direction C indicated in FIG. 2(B)). FIG. 2(D) is a right side view of the conductor blocks 12 and 13 viewed from direction D indicated in FIG. 2(B).

As illustrated in FIG. 2(B) and FIG. 2(D), in the line transition device 11 of the present embodiment, an edge of a dielectric substrate 15 made of ceramic, such as alumina, is interposed between the upper conductor block 12 and the lower conductor block 13 and positioned in the middle of the conductor blocks 12 and 13. The dielectric substrate 15 is positioned such that the upper and lower surfaces thereof face the conductor blocks 12 and 13, respectively.

The upper conductor block 12 has a cap clearance 22 {FIG. 2(D)} for avoiding contact with the protective cap. The cap clearance 22 is formed by removing part of the upper conductor block 12 adjacent to the dielectric substrate 15. Choke grooves 19A and 19B are cut by the cap clearance 22 as best shown in FIG. 2(A). Thus, even if the protective cap is used to improve resistance of the electronic components and wiring elements against humidity, dust, and the like, it is possible to make the entire line transition device 11 compact.

As illustrated in FIG. 2(D), the lower conductor block 13 has a step for accommodating the dielectric substrate 15. The line transition device 11 is formed by bonding the dielectric substrate 15 to this step portion and bonding the upper conductor block 12 onto the bonded dielectric substrate 15. For example, a conductive adhesive is used for the bonding.

As illustrated in FIG. 2(A), the dielectric substrate 15 is provided with the microstrip line 18 including a ground conductor 17A and the line conductor 16. The lower conductor block 13 has a line groove 20, while the upper conductor block 12 has the choke grooves 19A and 19B.

As illustrated in FIG. 2(C), an upper waveguide groove 14A in the upper conductor block 12 and a lower waveguide groove 14B in the lower conductor block 13 constitute the waveguide 14. Although the waveguide 14 is a hollow waveguide having an empty space inside, the waveguide 14 may be a dielectric-filled waveguide (DFWG) filled with a dielectric material.

Figure 3:
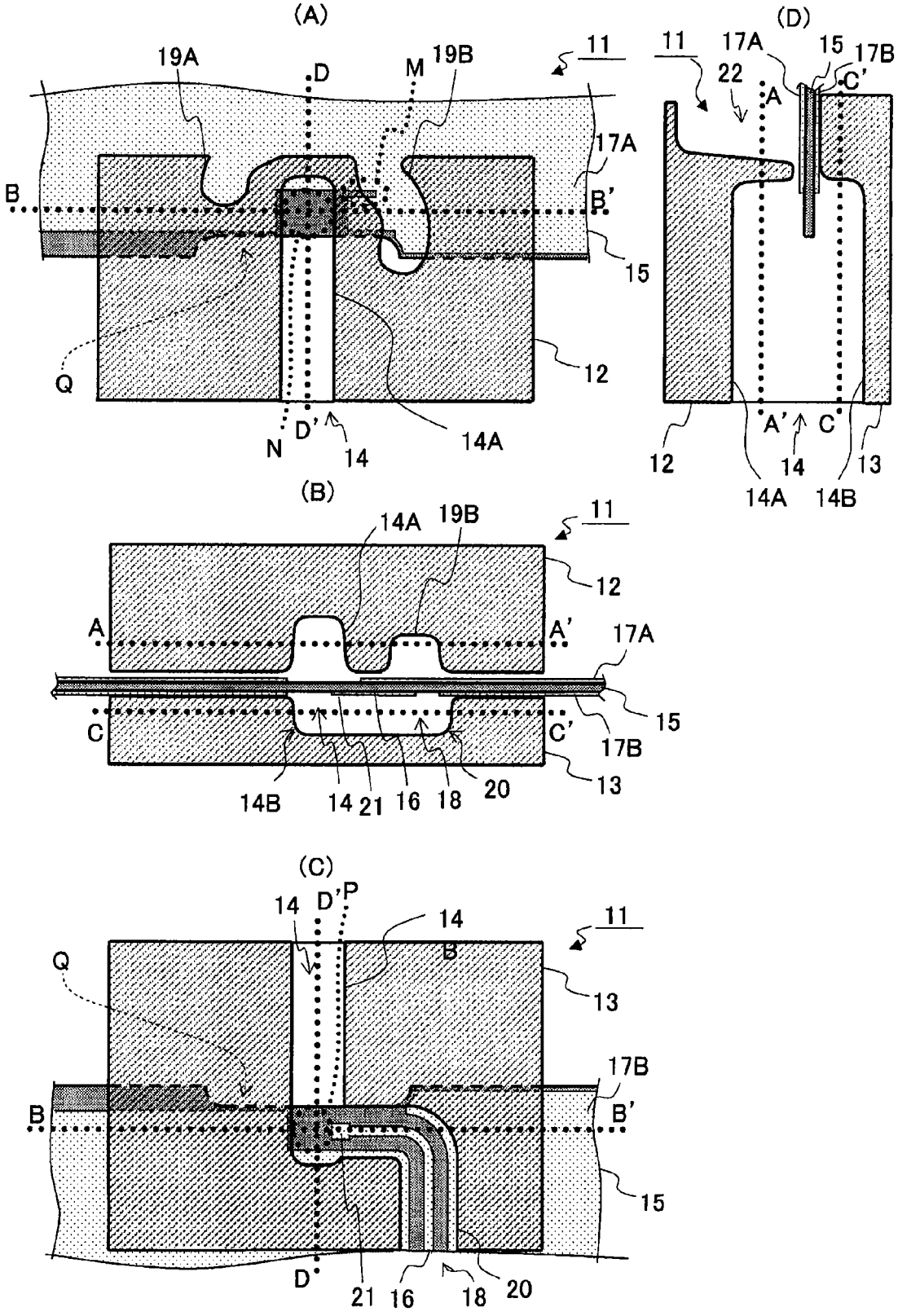
FIG. 3(A) to FIG. 3(D) are cross-sectional views illustrating the configuration of the line transition device according to the first embodiment.

FIGS. 3(A)-3(D) illustrate cross sections of the line transition device 11. FIG. 3(A) is a cross-sectional view illustrating the upper surface of the dielectric substrate 15 (i.e., a cross-sectional view taken along line A-A' of FIG. 3(B)). FIG. 3(C) is a cross-sectional view illustrating the lower surface of the dielectric substrate 15 (i.e., a cross-sectional view taken along line C-C' of FIG. 3(B)). FIG. 3(B) is a cross-sectional view taken along line B-B' of FIG. 3(C). FIG. 3(D) is a cross-sectional view taken along line D-D' of FIG. 3(A).

The waveguide 14 is composed of the upper waveguide groove 14A and the lower waveguide groove 14B as best shown in FIGS. 3(A) and 3(B). As illustrated in FIG. 3(A), the upper waveguide groove 14A is formed such that an end thereof is terminated near the center of the upper conductor block 12. As illustrated in FIG. 3(C), the lower waveguide groove 14B is bent near the center of the lower conductor block 13. The upper waveguide groove 14A and the lower waveguide groove 14B are formed such that their outlines coincide with each other. The bent portion of the lower waveguide groove 14B and the terminal end of the upper waveguide groove 14A constitute the terminal end of the waveguide 14.

Dimensions of the waveguide 14 are set such that a plane parallel to the interface between the upper conductor block 12 and the lower conductor block 13 (i.e., a conductor plane parallel to the planes illustrated in FIG. 3(A) and FIG. 3(C)) is the E-plane (i.e., a conductor plane parallel to an electric field in the TE10 mode, which is a mode of propagating electromagnetic waves), and that a plane orthogonal to the interface between the upper conductor block 12 and the lower conductor block 13 and parallel to the electromagnetic-wave propagation direction in the waveguide 14 (i.e., a plane parallel to the plane illustrated in FIG. 3(D)) is the H-plane (i.e., a conductor plane orthogonal to an electric field in the TE10 mode, which is a mode of propagating electromagnetic waves) of the waveguide.

As illustrated in FIG. 3(D), the dielectric substrate 15 is fit in the step portion of the lower conductor block 13. In the center of this step portion, there is provided a raised portion, which is fit in a recessed portion Q (illustrated in the center of FIG. 3(A) and FIG. 3(C)) at an edge of the dielectric substrate 15. Thus, positioning of the lower conductor block 13 and the dielectric substrate 15 is facilitated, and a fit between the lower conductor block 13 and the dielectric substrate 15 can be achieved with high positional accuracy.

As described above, the upper conductor block 12 is disposed on the lower conductor block 13, with the dielectric substrate 15 being fit in the step portion of the lower conductor block 13 and having a cap clearance 22 as depicted in FIG. 3(D). Thus, the dielectric substrate 15 is disposed parallel to the E-plane of the waveguide 14 and at substantially the center of the waveguide 14 (i.e., between the lower conductor block 13 and the upper conductor block 12) such that it extends from one H-plane to the other H-plane.

The recessed portion at an edge of the dielectric substrate 15 is formed in the process of manufacturing the dielectric substrate 15 by splitting an oval hole in a wafer and cutting the dielectric substrate 15 out of the wafer. The oval hole is provided to increase the dimensional accuracy of an electrode pattern with respect to the edge of the dielectric substrate 15. Since the dielectric substrate 15 is cut out of a wafer by splitting the recessed portion at the edge of the dielectric substrate 15, the dimensional accuracy of the line conductor 16 and a no-ground-conductor-formed region M (described below) with respect to the edge of the substrate can be increased regardless of processing accuracy in cutting the wafer and thus, stable high-frequency characteristics can be achieved.

As best shown in FIG. 3(A), the microstrip line 18 is composed of the line conductor 16 disposed on the lower surface of the dielectric substrate 15 and the ground conductor 17A disposed on the upper surface of the dielectric substrate 15. The ground conductor 17A covers substantially the entire upper surface of the dielectric substrate 15 and is electrically connected through a through hole (not shown) to a ground conductor 17B on the lower surface of the dielectric substrate 15. At an end of the microstrip line 18, the tip of the line conductor 16 extends beyond the ground conductor 17A and is provided with a rectangular electrode pattern, which serves as the coupling conductor 21. The coupling conductor 21 is positioned at the terminal end of the waveguide 14 described above. Part of the line conductor 16 extending from the coupling conductor 21 is orthogonal to the waveguide 14. The line conductor 16 extends along substantially the center of the line groove 20 and is bent at a position a predetermined distance from the waveguide 14.

The lower conductor block 13 facing the line conductor 16 has the line groove 20. The line groove 20 provides a predetermined space on the side of the line conductor 16 of the microstrip line 18. Thus, electromagnetic waves in the microstrip line 18 are prevented from being blocked by the lower conductor block 13. As illustrated in FIG. 3(C), the line groove 20 extends continuously from the lower waveguide groove 14B and is bent near the center of the lower conductor block 13, as described above.

The coupling conductor 21 at the end of the microstrip line 18 is positioned at the terminal end of and inside the waveguide 14 and, as illustrated in FIG. 3(A), forms a region N where the ground conductor 17A is not provided. Additionally, there is provided the slit-like no-ground-conductor-formed region M (which is a no-ground-conductor-formed part according to the present invention) extending continuously from the region N. The no-ground-conductor-formed region M is parallel to the line conductor 16 of the microstrip line 18 and is closer to the terminal end of the waveguide 14 than the line conductor 16 is to the terminal end of the waveguide 14 by a predetermined distance. Moreover, at a position facing the region N and located on the lower surface of the dielectric substrate 15, there is formed a region P {FIG. 3(C)} where only the tip of the line conductor 16 is provided.

By positioning the coupling conductor 21 provided at the tip of the microstrip line 18 and the regions P and N with no electrode at a predetermined position inside the waveguide 14, a suspended line antenna is formed by a conductor at the terminal end of the waveguide 14, the coupling conductor 21, and the dielectric substrate 15. The suspended line antenna combines the mode of the waveguide 14 in the conductor block with that of the microstrip line 18 on the dielectric substrate 15.

If the conductor blocks 12 and 13 are simply disposed on both surfaces of the dielectric substrate 15, a gap created at the interface forms a discontinuity. Then, a spurious mode, such as a parallel plate mode, occurs in a parallel plate gap between the ground conductor 17 disposed on the upper surface of the dielectric substrate 15 and the upper conductor block 12. Thus, the spurious electromagnetic waves tend to leak through the gap. Therefore, in the present embodiment, the choke grooves 19A and 19B and the no-ground-conductor-formed region M are provided to prevent spurious electromagnetic waves from leaking through such a gap.

As best shown in FIG. 3(A), the choke grooves 19A and 19B are shaped to effectively block spurious electromagnetic waves. The choke grooves 19A and 19B are disposed around the terminal end of the waveguide 14 and are separated from the terminal end of the waveguide 14 by predetermined distances. Generally, the predetermined distances do not considerably deviate from a quarter of the free-space wavelength of electromagnetic waves in the waveguide.

Therefore, when the conductor blocks 12 and 13 are disposed on both surfaces of the dielectric substrate 15, electromagnetic waves tending to leak through a gap created at the interface are partially released into the space of the choke grooves 19A and 19B. That is, in FIG. 3(A), since the distance between the terminal end of the waveguide 14 and each of the choke grooves 19A and 19B is substantially equal to a quarter of the propagating wavelength, end portions of the choke grooves 19A and 19B form open ends and the terminal end of the waveguide 14 forms an equivalent short-circuit end. Thus, a radiation loss from the gap is suppressed, and a smooth flow of ground current through the ground conductor is achieved.

The longitudinal direction of the no-ground-conductor-formed region M is substantially parallel to the line conductor 16, and the longitudinal length of the no-ground-conductor-formed region M is substantially equal to the length corresponding to one quarter wavelength of a high-frequency signal propagating through the waveguide 14. Thus, it is possible to block spurious electromagnetic waves flowing along the ground conductor. Additionally, by making the longitudinal length of the no-ground-conductor-formed region M correspond to one quarter wavelength of the propagating signal, conductors near an end of the no-ground-conductor-formed region M adjacent to the choke groove 19A can be reliably short-circuited, which allows the terminal end of the waveguide to be equivalently open-circuited. Thus, a radiation loss from a gap is suppressed and a smooth flow of ground current through the ground conductor is achieved. The no-ground-conductor-formed region M may be provided on only one side of the line conductor 16 and at a position separated by a predetermined distance from the line conductor 16, or may be provided on both sides of the line conductor 16 and at positions separated by predetermined distances from the line conductor 16.

Next, the results of simulations performed for predetermined design examples will be described with reference to FIGS. 4(A), 4(B). 5(A), 5(B), 6(A), 6(B) and 7. In the simulations, there were determined the distributions of intensity of surface current generated in the respective conductor surfaces of the ground conductor 17A and the upper conductor block 12 by spurious electromagnetic waves produced in a gap between the ground conductor 17A and the upper conductor block 12.

Figure 4:
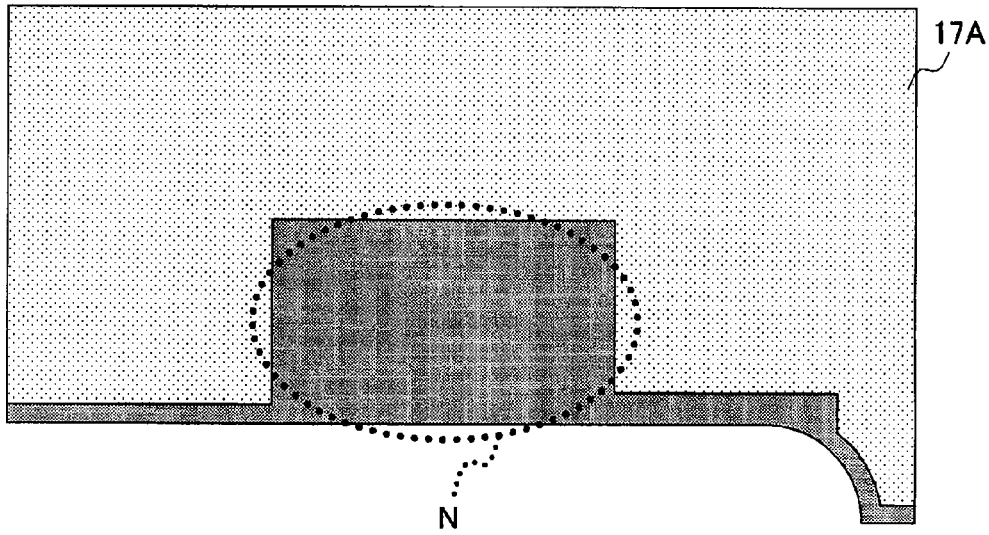
FIG. 4(A) and FIG. 4(B) illustrate electrode patterns used in electromagnetic field analysis simulations.
Figure 4:
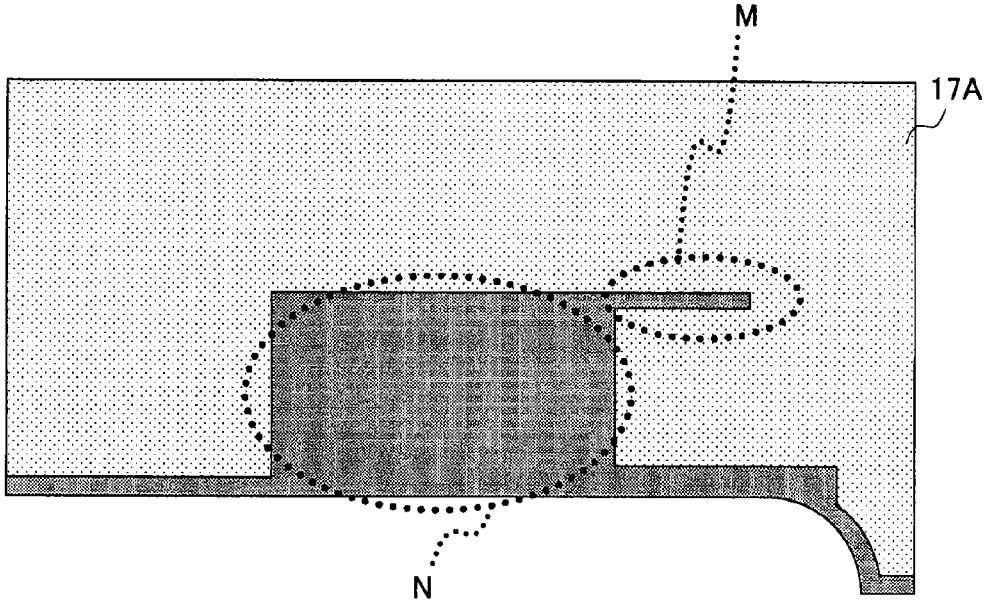
Figure 5:
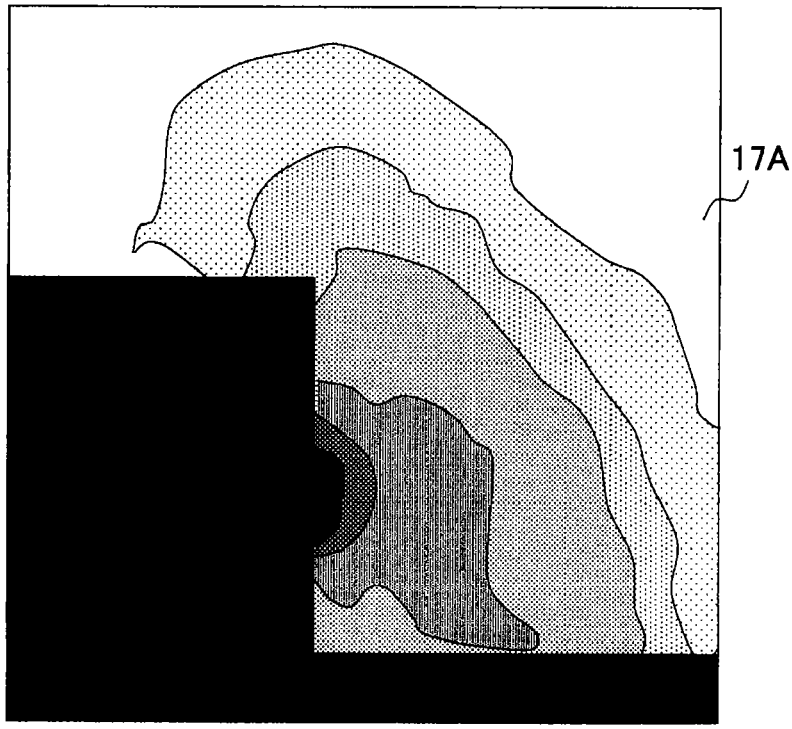
FIG. 5(A) and FIG. 5(B) illustrate distributions of surface current obtained in a ground conductor in the electromagnetic field analysis simulations.
Figure 5:
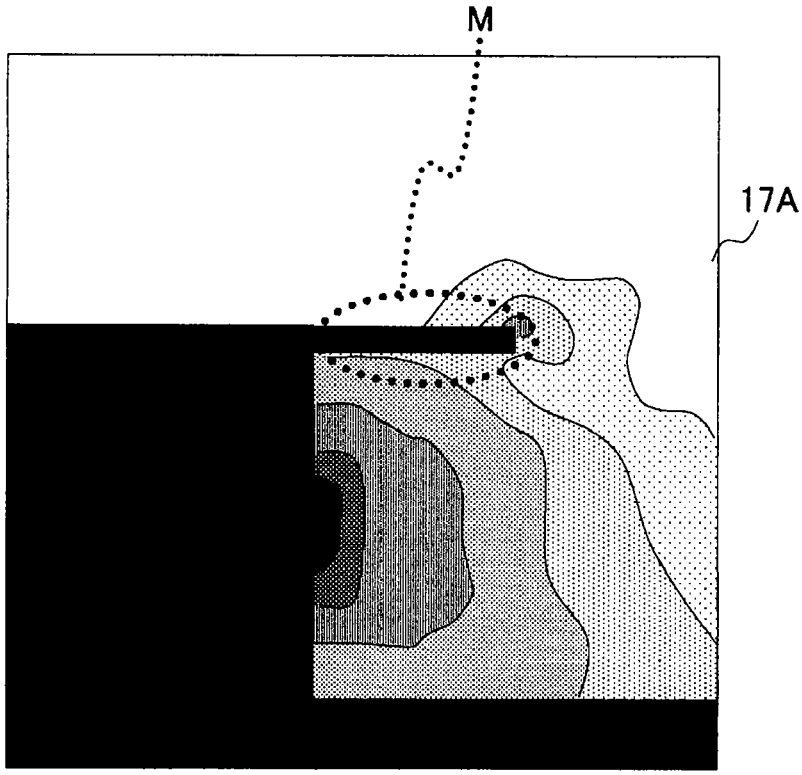
Figure 6:
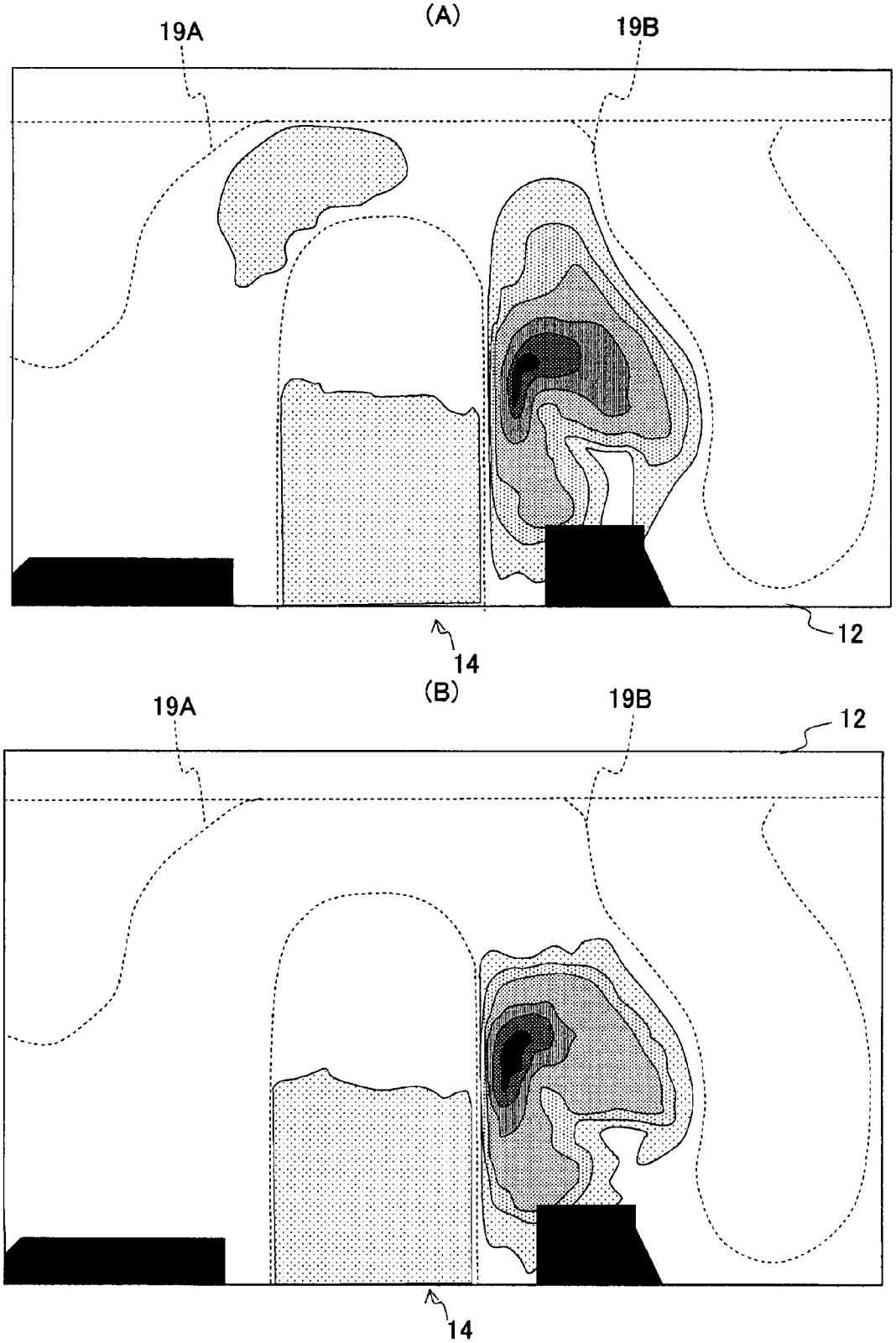
FIG. 6(A) and FIG. 6(B) illustrate distributions of surface current obtained in a conductor block in the electromagnetic field analysis simulations.
Figure 7:
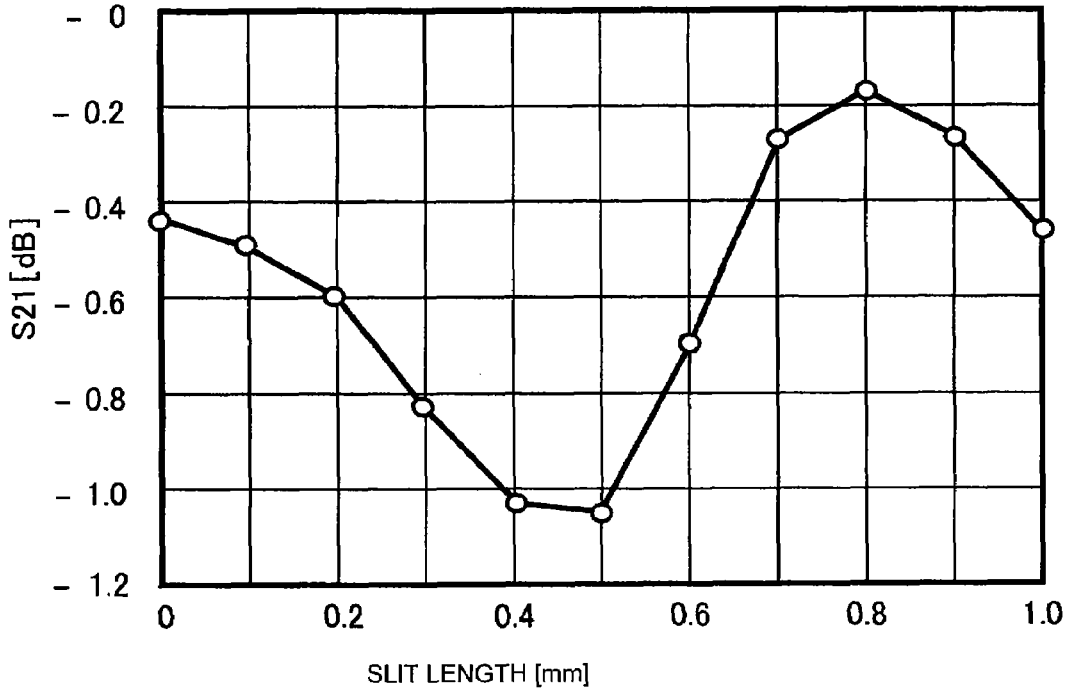
FIG. 7 is a graph showing a relationship between transmission loss and slit length obtained in the electromagnetic field analysis simulations.

FIGS. 4(A) and 4(B) illustrate wiring patterns used in three-dimensional electromagnetic field analysis simulations showing line transition in the waveguide 14 and the microstrip line 18. FIGS. 5(A) and 5(B) illustrate the distributions of intensity of surface current in the ground conductor 17A, obtained in the simulations. FIGS. 6(A) and 6(B) illustrate the distributions of intensity of surface current in the upper conductor block 12, obtained in the simulations. FIG. 4(A), FIG. 5(A), and FIG. 6(A) each illustrate the case where only choke grooves were provided. FIG. 4(B), FIG. 5(B), and FIG. 6(B) each illustrate the case where the no-ground-conductor-formed region M as well as the choke grooves were provided. FIG. 7 is a graph showing a power loss that varied with the longitudinal length of the no-ground-conductor-formed region M (i.e., slit length).

As is apparent from a comparison between FIG. 5(A) and FIG. 5(B), the flow of surface current in the ground conductor 17A was blocked by the no-ground-conductor-formed region M. Additionally, as is apparent from a comparison between FIG. 6(A) and FIG. 6(B), in the conductor surface of the upper conductor block 12, no surface current was generated in an area beyond the location facing the no-ground-conductor-formed region M (not shown therein).

This is because since spurious electromagnetic waves were suppressed by the no-ground-conductor-formed region M, a surface current to be excited in the conductor surface by the spurious electromagnetic waves was suppressed. Thus, spurious electromagnetic waves can be effectively suppressed by the presence of the no-ground-conductor-formed region M.

FIG. 7 shows a change in power loss (transmission loss S21 [dB]) with respect to a change in the length of a slit designed preferably for 76 GHz band electromagnetic waves. The free-space wavelength of the 76 GHz band electromagnetic waves is about 4.0 mm, and one quarter wavelength thereof is about 1.0 mm. The optimum slit length obtained in the simulations was 0.8 mm, which is slightly smaller than the one quarter wavelength because of a wavelength shortening effect caused by neighboring dielectrics and conductors. With the slit length of 0.8 mm, a power loss was suppressed to a much greater degree than the case where the slit length was 0.0 mm (i.e., absent). This is because spurious electromagnetic waves were able to be suppressed as described above, and surface conductors of the waveguide were able to be reliably short-circuited.

As described above, with the no-ground-conductor-formed region M provided at a position where spurious electromagnetic waves cannot be sufficiently suppressed only by choke grooves or at a position where no choke groove can be provided and electromagnetic waves leak, spurious electromagnetic waves can be effectively suppressed and the coupling between the waveguide and the planar circuit (microstrip line) can be improved. Additionally, a transmission loss can be effectively suppressed by an appropriate choice of the slit length.

Moreover, since there is no need to provide, for example, a square U-shaped choke groove around the entire terminal end of a waveguide, the size of a conductor block can be reduced. Thus, it is possible to provide a smaller line transition device capable of more effectively suppressing a transmission loss than a line transition device of conventional type.

Although the waveguide described above is a hollow waveguide, a dielectric-filled waveguide or a dielectric line formed by inserting a dielectric strip between parallel planar conductors, particularly a nonradiative dielectric line, may be used as a waveguide.

Next, exemplary modifications of the line transition device will be described with reference to FIGS. 8(A)-8(C).

Figure 8:
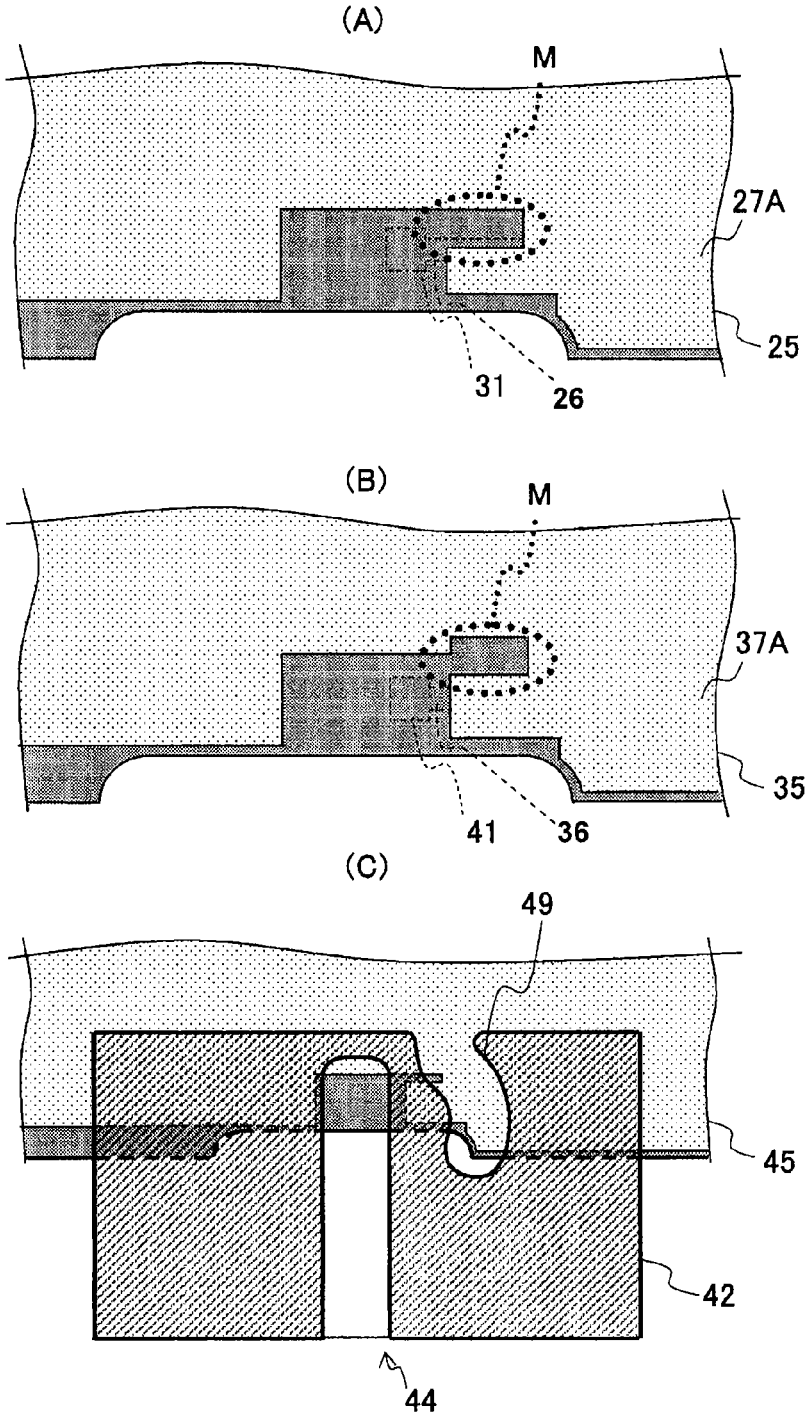
FIG. 8(A) to FIG. 8(C) each illustrate an exemplary modification of the line transition device according to the first embodiment.

Like the exemplary modification illustrated in FIG. 8(A), the no-ground-conductor-formed region M provided in a ground conductor 27A on a dielectric substrate 25 may have a greater width and extend to a position facing a line conductor 26 having coupling conductor 31, or may be of any shape which allows the ground conductor 27A to act as a ground of a microstrip line.

Alternatively, like the exemplary modification illustrated in FIG. 8(B), the no-ground-conductor-formed region M provided in a ground conductor 37A on a dielectric substrate 35 may extend in a direction opposite a line conductor 36 having coupling conductor 41. Since this makes it possible to ensure a ground surface area greater than that in the case of the exemplary modification illustrated in FIG. 8(A), a difference from the impedance of a microstrip line can be reduced.

Alternatively, like the exemplary modification illustrated in FIG. 8(C), in an area surrounding the terminal end of a waveguide 44 in a conductor block 42, a choke groove 49 may be provided on only one side of a dielectric substrate 45 adjacent to a microstrip line. With this configuration, it is still possible to suppress spurious electromagnetic waves and improve coupling between the waveguide and a planar circuit (microstrip line).

Next, a configuration of a high-frequency module and a communication apparatus according to a second embodiment of the present invention will be described with reference to FIG. 9.

Figure 9:
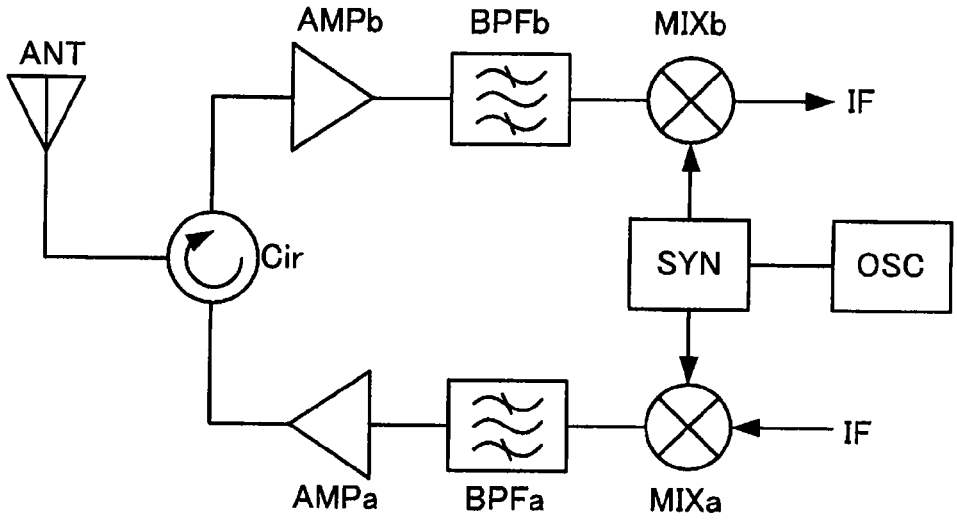
FIG. 9 is a block diagram illustrating a configuration of a high-frequency module and a transmitting/receiving unit of a communication apparatus according to a second embodiment of the present invention.

FIG. 9 is a block diagram illustrating a configuration of the high-frequency module and a transmitting/receiving unit of the communication apparatus.

In FIG. 9, ANT denotes a transmitting/receiving antenna, Cir denotes a circulator, BPFa and BPFb each denote a band-pass filter, AMPa and AMPb each denote an amplifier circuit, MIXa and MIXb each denote a mixer, OSC denotes an oscillator, SYN denotes a synthesizer, and IF denotes an intermediate-frequency signal.

Mixer MIXa mixes input IF signals with signals output from synthesizer SYN. Only the mixed output signals from mixer MIXa in a transmission frequency band are passed by band-pass filter BPFa and transmitted to amplifier AMPa. Amplifier AMPa power-amplifies and transmits them from antenna ANT through circulator Cir. Amplifier AMPb amplifies received signals extracted from circulator Cir. Only the received signals output from amplifier AMPb in a reception frequency band are passed by band-pass filter BPFb. Mixer MIXb mixes the received signals with frequency signals output from synthesizer SYN and outputs intermediate-frequency signals IF.

In the amplifier circuits AMPa and AMPb illustrated in FIG. 9, a high-frequency component including a line transition device with the configuration of the first embodiment is used. That is, a dielectric-filled waveguide or a hollow waveguide is used as a transmission line, and a planar circuit including an amplifier circuit formed on a dielectric substrate is used. Thus, by using the amplifier circuit and the high-frequency component including the line transition device, it is possible to provide a high-frequency module exhibiting low loss and excellent communication performance, and to provide a communication apparatus having a transmitting/receiving unit which includes the high-frequency module and exhibiting low loss and excellent communication performance.

The high-frequency module and the communication apparatus may be formed by connecting the illustrated configuration to a signal processing circuit including an encoding/decoding circuit, a synchronous control circuit, a modulator, a demodulator, a CPU, and the like. With this configuration, it is still possible to provide a communication apparatus exhibiting low loss and excellent communication performance by including the line transition device of the present invention in a transmitting/receiving unit for transmitting and receiving electromagnetic waves.

The invention claimed is:

1. A line transition device comprising:

a conductor block;

a waveguide provided in the conductor block;

a microstrip line including:

a dielectric substrate having a first and a second surface;

a line conductor disposed on the first surface of the dielectric substrate;

a ground conductor disposed on the second surface of the dielectric substrate, the second surface including a region where the ground conductor is not provided; and a coupling conductor formed at an end of the line conductor and opposite the region where the ground conductor is not provided, the coupling conductor being positioned at a terminal end of the waveguide and inside the waveguide, the conductor block having a choke groove located at a position facing the ground conductor and surrounding the terminal end of the waveguide at a predetermined distance therefrom; and a slit-like no-ground-conductor-formed part extending from the region where the ground conductor is not provided and near a boundary between the coupling conductor and the microstrip line.

2. A high-frequency module comprising:

the line transition device according to claim 1; and a high-frequency circuit connected to both the waveguide and the microstrip line of the line transition device.

3. A communication apparatus comprising:

the high-frequency module of claim 2 in a transmitting/receiving unit for transmitting and receiving electromagnetic waves.

4. The line transition device according to claim 1, wherein the waveguide is one of a hollow waveguide, a dielectric-filled waveguide, and a dielectric line.

5. The line transition device according to claim 1, wherein the no-ground-conductor-formed part extends to a position facing the line conductor.

6. The line transition device according to claim 1, wherein the no-ground-conductor-formed part extends to a position opposite the line conductor.

7. The line transition device according to claim 1, wherein a longitudinal length of the no-ground-conductor-formed part is substantially equal to a quarter of the wavelength of electromagnetic waves propagating through the waveguide.

8. A line transition device comprising:

a conductor block;

a wave guide provided in the conductor block;

a microstrip line including a line conductor and a ground conductor disposed on a dielectric substrate; and a coupling conductor formed at an end of the line conductor beyond an end of the ground conductor, the coupling conductor being positioned at a terminal end of the waveguide and inside the waveguide, the conductor block having a choke groove located at a position facing the ground conductor and surrounding the terminal end of the waveguide at a predetermined distance therefrom; and a slit-like no-ground-conductor-formed part provided near a boundary between the coupling conductor and the microstrip line and at the end of the ground conductor, wherein the choke groove at least crosses the microstrip line, and the no-ground-conductor-formed part extends from the end of the ground conductor to the choke groove so as to be substantially parallel to the microstrip line.

9. A line transition device comprising:

a conductor block;

a waveguide provided in the conductor block;

a microstrip line including a line conductor and a ground conductor disposed on a dielectric substrate; and a coupling conductor formed at an end of the line conductor beyond an end of the ground conductor, the coupling conductor being positioned at a terminal end of the waveguide and inside the wave guide, the conductor block having a first choke groove located at a position facing the ground conductor and surrounding the terminal end of the waveguide at a predetermined distance therefrom;

a slit-like no-ground-conductor-formed part provided near a boundary between the coupling conductor and the microstrip line and at the end of the ground conductor; and a second choke groove in the conductor block, the second choke groove located at a position facing the ground conductor and surrounding the terminal end of the waveguide.

* * * * *